US008800501B2

(12) United States Patent
Berthiaume

(10) Patent No.: US 8,800,501 B2
(45) Date of Patent: Aug. 12, 2014

(54) ROTATING AND RECIPROCATING PISTON DEVICE

(76) Inventor: Sylvain Berthiaume, St-Jean-sur-Richelieu (CA)

( * ) Notice: Subject to any disclaimer, the term of this patent is extended or adjusted under 35 U.S.C. 154(b) by 212 days.

(21) Appl. No.: 13/187,508

(22) Filed: Jul. 20, 2011

(65) Prior Publication Data

US 2012/0020823 A1 Jan. 26, 2012

Related U.S. Application Data

(60) Provisional application No. 61/365,942, filed on Jul. 20, 2010.

(51) Int. Cl.
*F02B 57/08* (2006.01)
*F04B 27/04* (2006.01)
*F04B 27/047* (2006.01)

(52) U.S. Cl.
CPC ..... *F04B 27/047* (2013.01); *F04B 27/0409* (2013.01); *F02B 57/08* (2013.01); *F04B 27/0472* (2013.01)
USPC ..... 123/18 R

(58) Field of Classification Search
USPC ..... 123/18 R, 44 R, 44 C, 44 D, 44 E, 43 A, 123/56.8; 92/72–74, 146–152, 117 R–119
See application file for complete search history.

(56) References Cited

U.S. PATENT DOCUMENTS

| | | | | |
|---|---|---|---|---|
| 564,155 | A | 7/1896 | Millet | |
| 1,533,514 | A * | 4/1925 | Ragot | 91/492 |
| 2,036,060 | A * | 3/1936 | Newton | 123/44 C |
| 3,568,645 | A * | 3/1971 | Grimm | 418/264 |
| 3,752,605 | A * | 8/1973 | Newton | 418/8 |
| 3,904,327 | A * | 9/1975 | Edwards et al. | 418/8 |
| 4,078,529 | A | 3/1978 | Warwick | |
| 4,836,149 | A * | 6/1989 | Newbold | 123/44 R |
| 5,636,599 | A | 6/1997 | Russell | |
| 5,848,565 | A * | 12/1998 | Thoma | 91/491 |
| 6,230,670 | B1 * | 5/2001 | Russell | 123/44 B |
| 6,615,793 | B1 | 9/2003 | Usack | |
| 6,895,906 | B1 * | 5/2005 | Gahan | 123/44 D |
| 6,938,590 | B2 * | 9/2005 | Buelna | 123/56.8 |
| 7,353,784 | B2 | 4/2008 | Nicholson | |
| 7,673,595 | B2 * | 3/2010 | Pelov | 123/44 D |
| 7,677,207 | B2 | 3/2010 | Nicholson | |
| 7,721,685 | B2 * | 5/2010 | Page | 123/43 AA |

(Continued)

FOREIGN PATENT DOCUMENTS

| | | |
|---|---|---|
| CA | 2328671 | 6/2002 |
| EP | 1158162 | 11/2001 |
| WO | WO 03/044373 | 5/2003 |
| WO | WO 2007/095042 | 8/2007 |

*Primary Examiner* — Thomas Denion
*Assistant Examiner* — Shafiq Mian
(74) *Attorney, Agent, or Firm* — Benoît & Côté Inc.

(57) ABSTRACT

The present document describes a rotating and reciprocating piston device comprising: chambers disposed about a chamber axis, the chambers having two ends and a port for passage of a fluid at each one of the ends of the chambers; pistons having two ends, each one of the pistons slidably positioned within a respective one of the chambers thereby determining a space at either end of each piston within its respective chamber; and a track forming a closed circuit through which the chamber axis passes, the track for determining a position of a piston within its respective chamber and hence the space on either side thereof.

16 Claims, 27 Drawing Sheets

(56) References Cited

U.S. PATENT DOCUMENTS

| | | | | |
|---|---|---|---|---|
| 8,225,753 | B2 * | 7/2012 | Sorrels | 123/43 R |
| 8,316,817 | B2 * | 11/2012 | Rucker et al. | 123/212 |
| 2002/0059907 | A1 * | 5/2002 | Thomas | 123/43 AA |
| 2003/0213452 | A1 * | 11/2003 | Pomerleau | 123/90.29 |
| 2004/0163619 | A1 * | 8/2004 | Thomas | 123/241 |
| 2005/0109294 | A1 * | 5/2005 | Wondergem et al. | 123/44 R |
| 2010/0006059 | A1 | 1/2010 | Tradler | |

* cited by examiner

ROTATING AND RECIPROCATING PISTON DEVICE

CROSS-REFERENCE TO RELATED APPLICATIONS

This application claims priority under 35 USC§119(e) of U.S. provisional patent application 61/365,942 filed on Jul. 20, 2010, the specification of which is hereby incorporated by reference.

TECHNICAL FIELD

This description relates to the field of engines and compressors. More particularly, this description relates to rotary type engines and compressors.

BACKGROUND

An engine is a machine designed to convert energy into mechanical motion. A compressor is a device used for increasing pressure of a gas by reducing its volume.

Various types of engines exist. Among them, internal combustion engines with reciprocating pistons are most popular in cars today. Another type of internal combustion engine is the Wankel engine in which triangular shaped rotor and an epotrochoid-shaped casing interact to create compression and expansion chambers. Yet another type of engines is a rotary engine which is an internal combustion engine where the radially-mounted cylinders and pistons rotate around a fixed crankshaft.

There are also various types of compressors, namely reciprocating, rotary, centrifugal and axial.

Existing engines and compressors all have inefficiencies which are constantly being reduced.

There is therefore a need for a rotating and reciprocating efficient piston device.

SUMMARY

There is described herein a rotating and reciprocating piston device which can be used in an engine application, a compressor or a pump application.

According to an embodiment, there is provided a rotating and reciprocating piston device comprising: chambers disposed about a chamber axis, the chambers having two ends and a port for passage of a fluid at each one of the ends of the chambers; pistons having two ends, each one of the pistons slidably positioned within a respective one of the chambers thereby determining a space at either end of each piston within its respective chamber; a track forming a closed circuit through which the chamber axis passes; and guiding devices, each one of the guiding devices for guiding a respective one of the pistons along the track; wherein during operation: the device cycles through a plurality of stages wherein a position of a piston within its respective chamber determines the stage for that piston and hence the space on either side thereof; each piston slides within its respective chamber and thereby continuously varies the space at either end of each piston within its respective chamber; and each port admits or exhausts the fluid respectively to or from the space depending on the stage of the plurality of stages.

According to an aspect, one of the chambers and the track is static, and the other one of the chambers and the track is free to rotate about the chamber axis.

According to an aspect, the rotating and reciprocating piston device further comprises a transmission device for transmitting energy to or receiving energy from the rotating and reciprocating piston device.

According to an aspect, the transmission device comprises one of a shaft, a belt, a chain, a gear mechanism, a wheel, and an electro-magnetic device.

According to an aspect, the rotating and reciprocating piston device further comprises a track plate on which the track is located.

According to an aspect, the chambers are located substantially with a chamber plane and wherein the track plate comprises a first track plate and a second track plate, each track plate comprising a track, the first track plate located on one side of the chamber plane and the second track plate located on the opposite side of the chamber plane.

According to an aspect, the first track plate and the second track plate are connected via a gear device.

According to an aspect, the first track plate further comprises a shaft receptor portion located in the chamber axis for mounting a rotatable shaft to the first track plate, the rotatable shaft for transmitting or receiving energy to or from the rotating and reciprocating piston device.

According to an aspect, the second plate comprises a void substantially at a center thereof for providing access to the end of the chambers closest to the chamber axis.

According to an aspect, the gear device comprises a gear device axis about which it rotates during operation and shaft receptor portion located in the gear device axis for mounting a rotatable shaft to the gear device, the rotatable shaft for transmitting or receiving energy to or from the rotating and reciprocating piston device.

According to an aspect, the rotating and reciprocating piston device further comprises a chamber block located substantially within a chamber plane, the chambers being formed in the chamber block.

According to an aspect, the piston chamber block further comprises a shaft receptor portion in the central axis for connecting a rotatable shaft to the track plate.

According to an aspect, the track comprises one of a groove and a protrusion.

According to an aspect, the track comprises a symmetrical shape.

According to an aspect, the symmetrical shape is either centered on the chamber axis or off center from on the chamber axis.

According to an aspect, the rotating and reciprocating piston device further comprises valves for controlling the passage of fluid through the ports.

According to an aspect, the rotating and reciprocating piston device further comprises a valve track forming a closed circuit through which the chamber axis passes, the valve track controlling the operation valves.

According to an aspect, the rotating and reciprocating piston device further comprises spark plugs, a respective one of the spark plugs located at each of the two ends of each of the chambers.

According to an aspect, the number of pistons is equal to the number of chambers.

According to an embodiment, there is provided a rotating and reciprocating piston device comprising: chambers disposed about a chamber axis, the chambers having two ends and a port for passage of a fluid at each one of the ends of the chambers; pistons having two ends, each one of the pistons slidably positioned within a respective one of the chambers thereby determining a space at either end of each piston within its respective chamber; and a track forming a closed circuit through which the chamber axis passes, the track for determining a position of a piston within its respective chamber and hence the space on either side thereof.

According to an embodiment, there is provided a rotating and reciprocating piston device comprising a track plate comprising a track forming a closed circuit, a piston chamber block having defined therein chambers having two ends and an air admission or an exhaust port at each one of the ends of the chambers, pistons having two ends, each one of the pistons being located within a respective one of the chambers, guiding devices, each one of the guiding devices mounted to a respective one of the pistons, the guiding devices adapted to travel along the track; wherein during operation, the device cycles through a plurality of stages, each piston travels within its respective chamber and thereby creates spaces of continuously varying sizes within its respective chamber at either end of each piston, and the spaces within the chambers on either side of each the pistons admit or exhaust gases depending on the stage of the plurality of stages within which are the pistons, the track, via each guiding device, determines a position of each piston within its respective chamber.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 11:
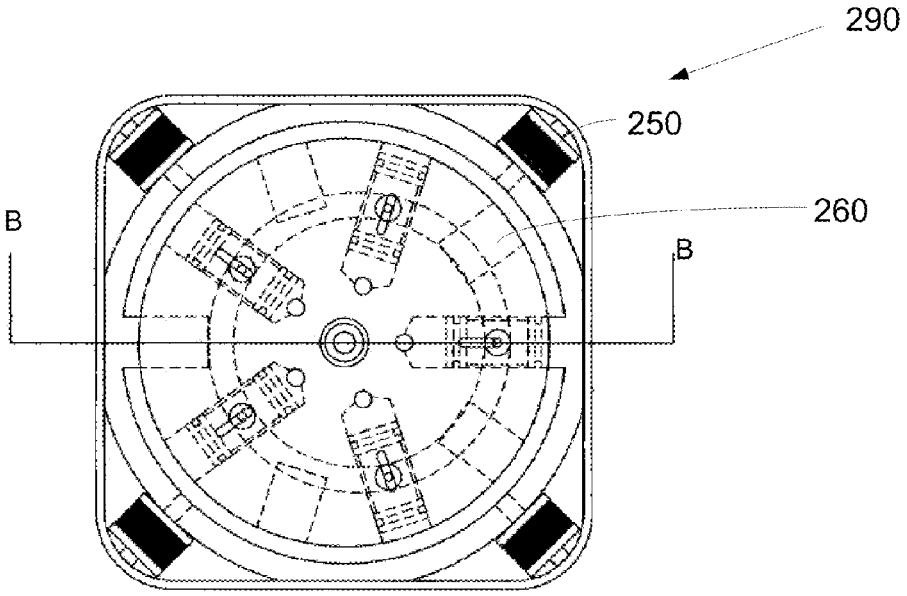
FIG. 11 is a schematic diagram showing a top plan view of another embodiment of a rotating and reciprocating piston device in an electric generator or hybrid engine application.
Figure 12:
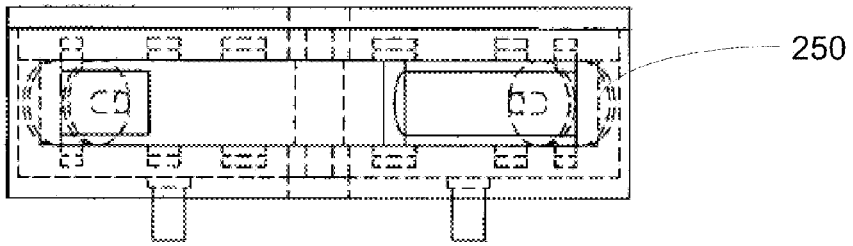
FIG. 12 is a side cutout view along line B-B of the rotating and reciprocating piston device of FIG. 11.
Figure 13:
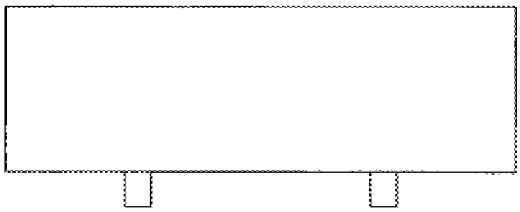
FIG. 13 is a side elevation view of the rotating and reciprocating piston device of FIG. 11.
Figure 14:
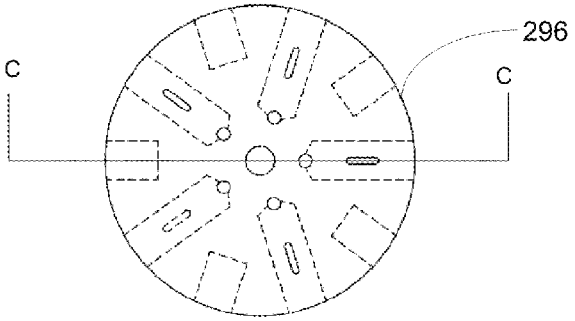
FIG. 14 is a schematic diagram showing a top plan view of another embodiment of a rotating and reciprocating piston device.
Figure 15:
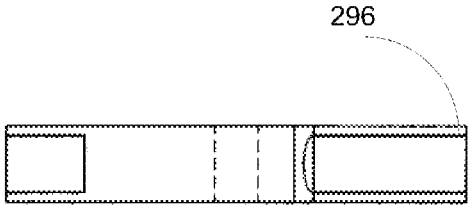
FIGS. 15 and 16 are cutout views along line C-C of the piston chamber block of the rotating and reciprocating piston device of FIG. 14 at different moments.
Figure 16:
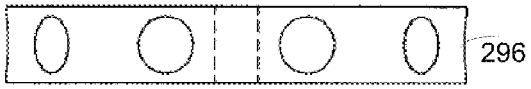
Figure 17:
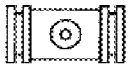
FIG. 17 is a top elevation view of a piston of FIG. 14.
Figure 19:
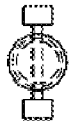
FIG. 19 is a side view of a piston of FIG. 14.
Figure 18:
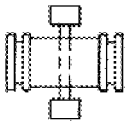
FIG. 18 is a front elevation view of a piston of FIG. 14.
Figure 20:
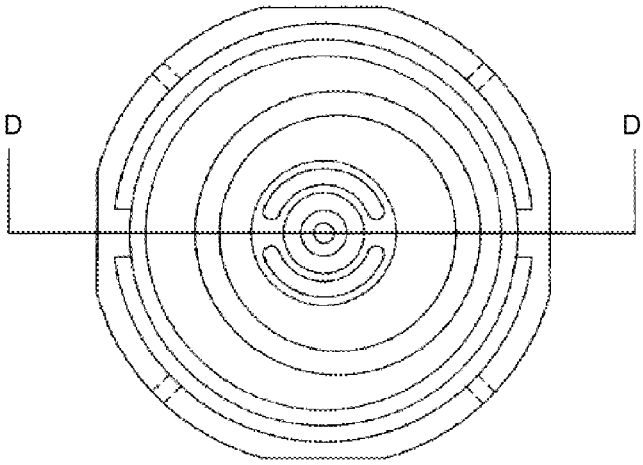
FIG. 20 is a schematic diagram showing a top plan view of another embodiment of a rotating and reciprocating piston device.
Figure 39:
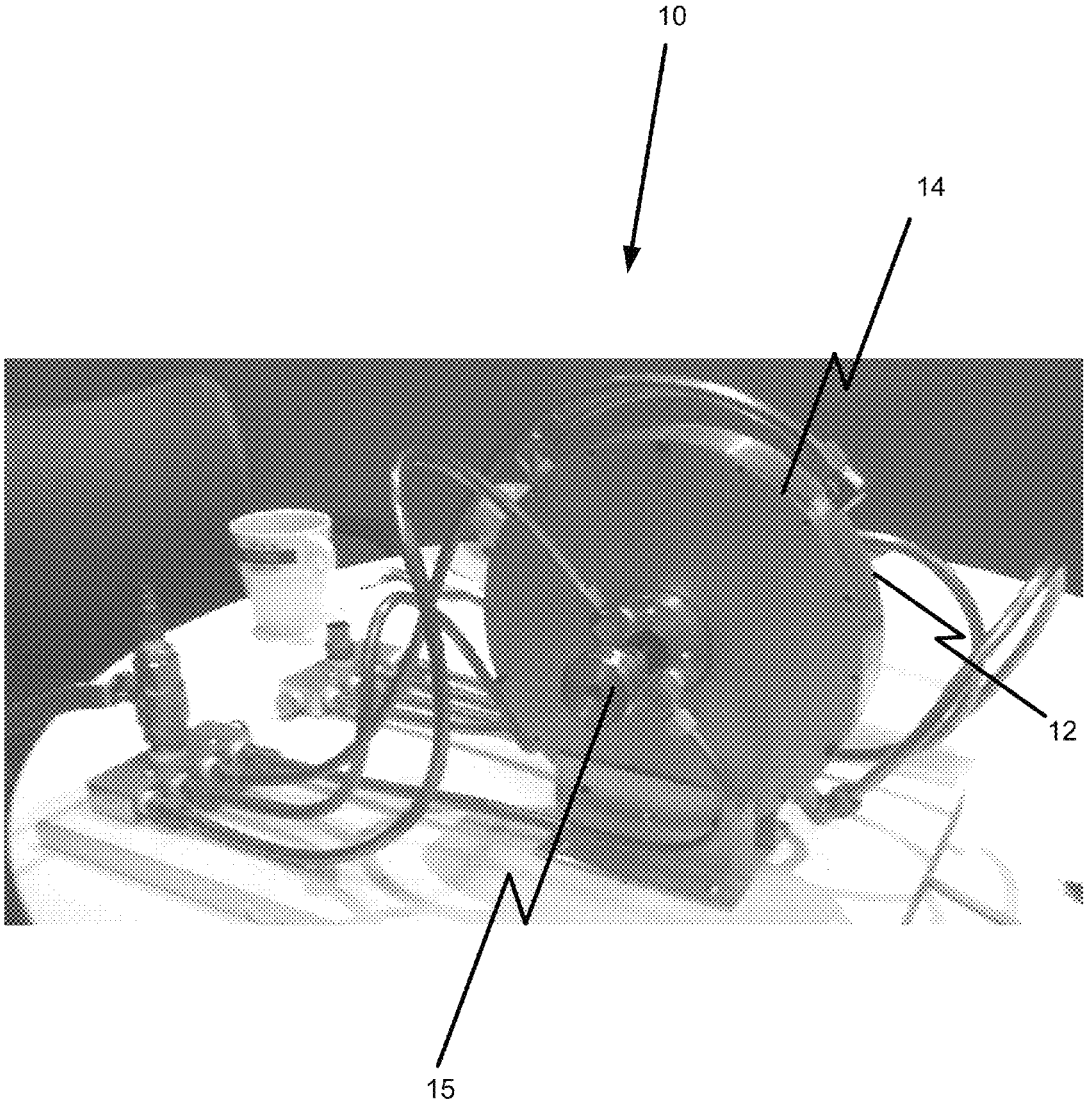
FIG. 39 is a picture of rotating and reciprocating piston device in accordance with an embodiment.
Figure 40:
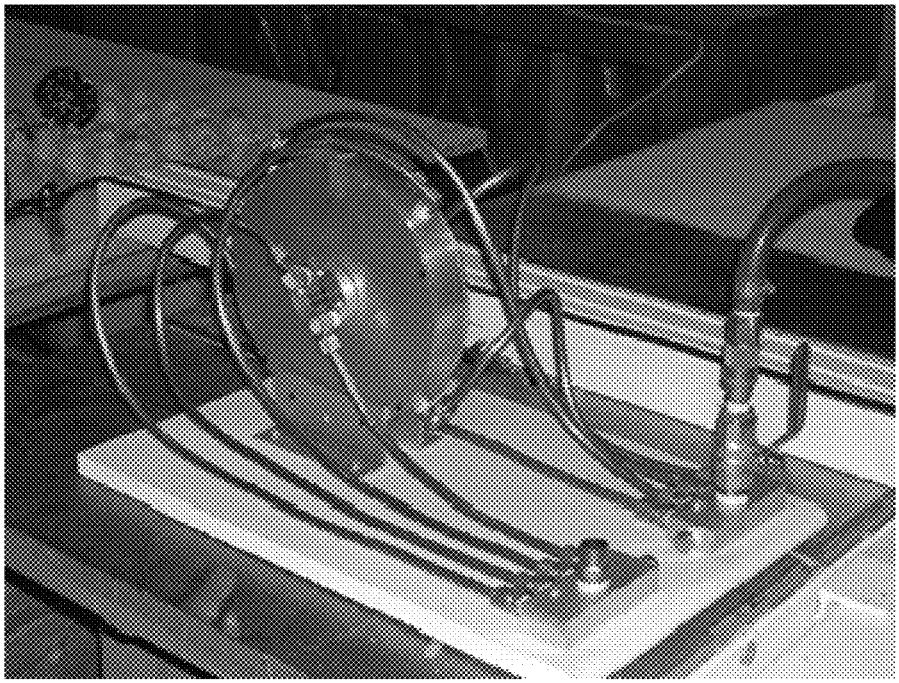
FIG. 40 is a picture of a rotating and reciprocating device in accordance with an embodiment.
Figure 41:
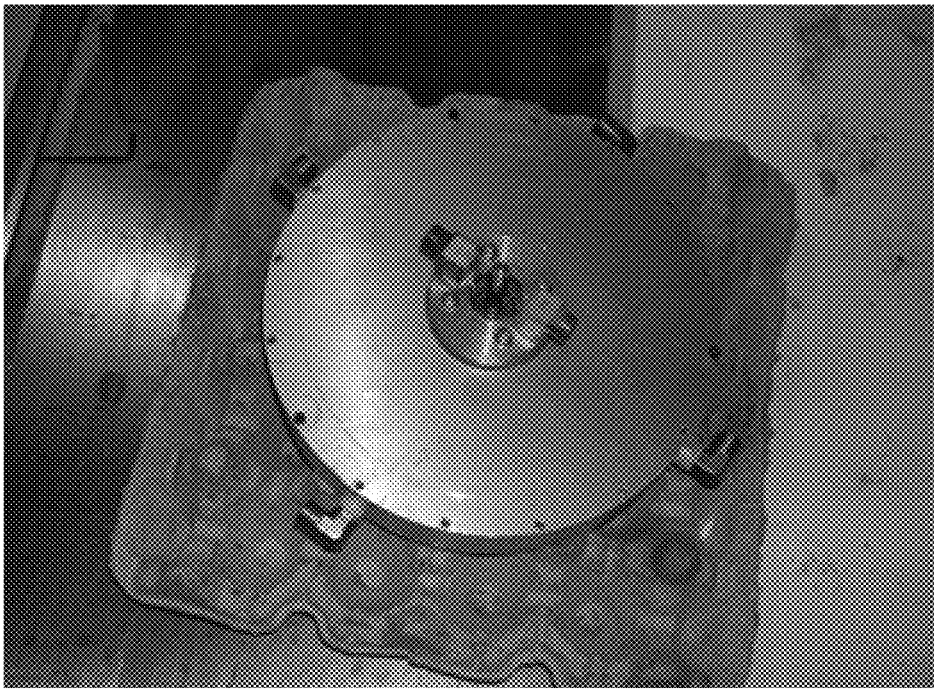
FIG. 41 is a picture showing a cover for a rotating and reciprocating piston device in accordance with an embodiment showing a rotatable shaft.
Figure 42:
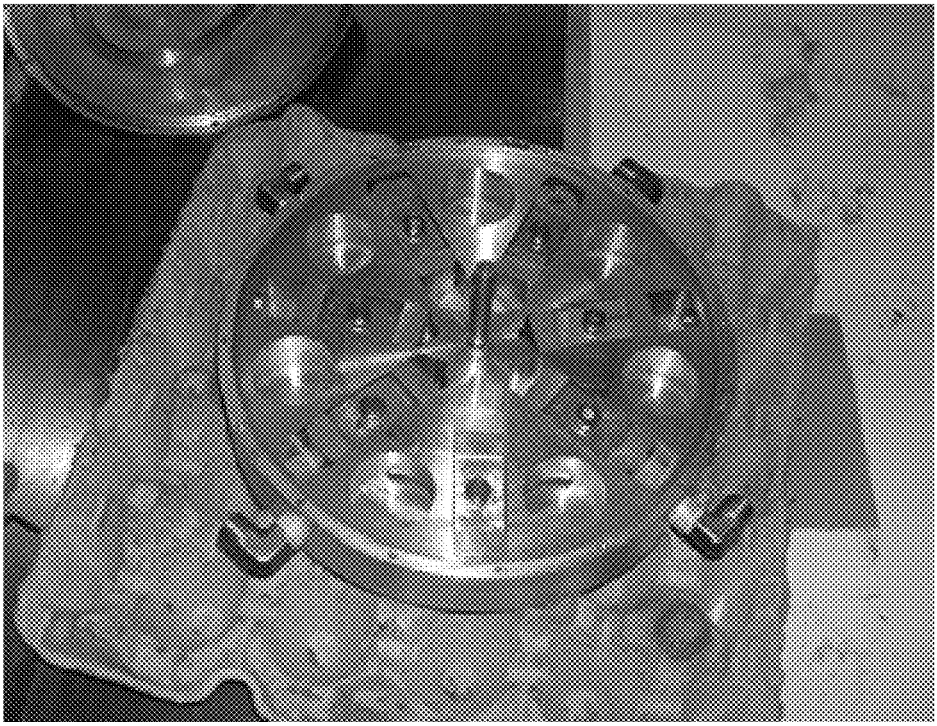
FIG. 42 is a picture of a piston chamber block with its pistons (without its cover) of a rotating and reciprocating piston device.
Figure 43:
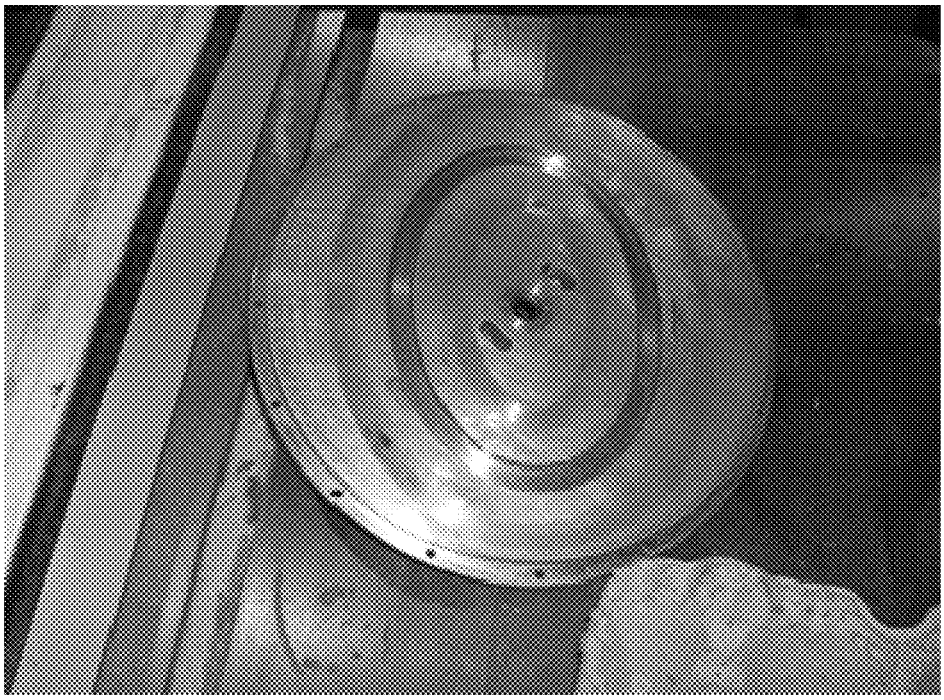
FIG. 43 is a picture showing a track plate with its track for a rotating and reciprocating piston device in accordance with an embodiment.
Figure 44:
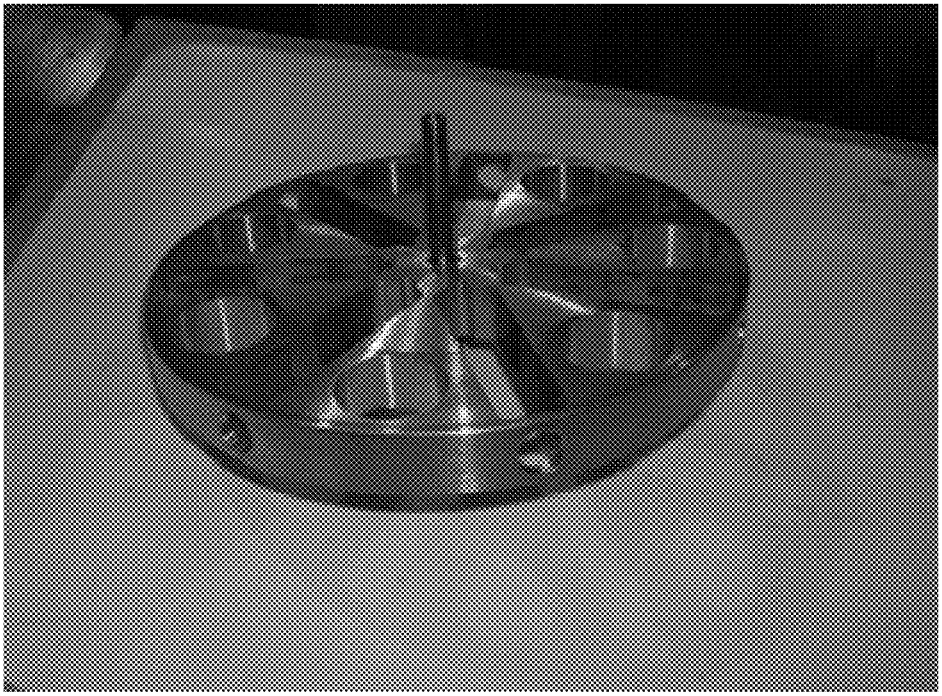
FIG. 44 is showing a piston chamber block with its shaft of a rotating and reciprocating piston device.
Figure 45:
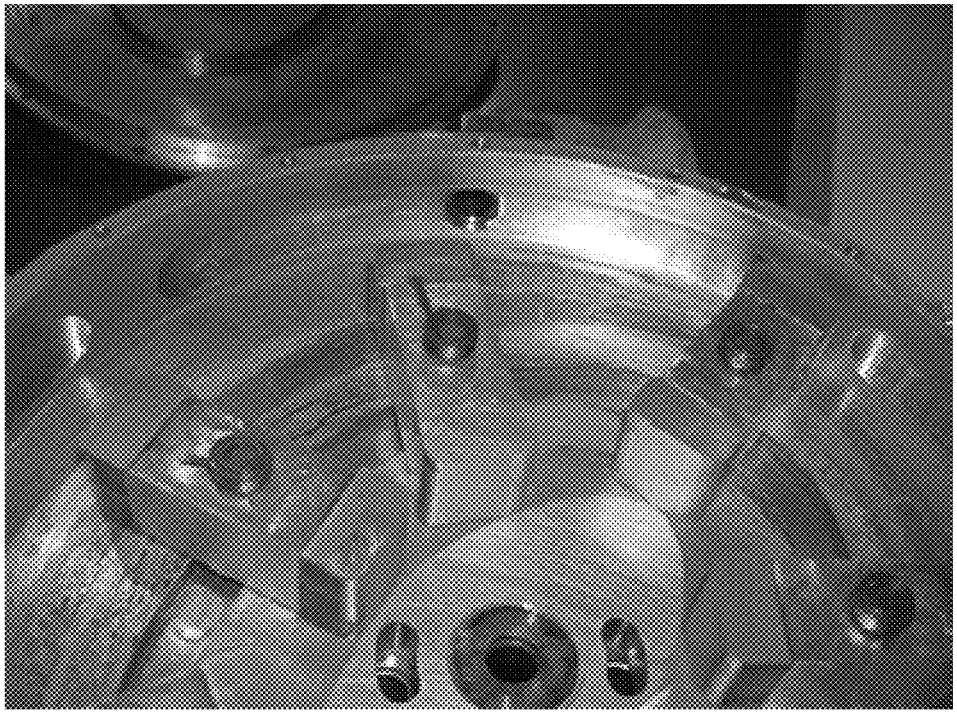
FIG. 45 is a picture showing a partial view in accordance with an embodiment of piston chamber block and pistons placed therein the cover.

Many interesting applications for rotating and reciprocating piston device 10 exist. These applications include a four-stroke engine (FIG. 5), an electric generator (FIG. 11), a hybrid engine, a compressor (FIG. 39), and, in combination with a compressed air tank, an energy reservoir.

Referring now to the drawings, and more particularly to FIGS. 1, 1*a*, 1*b*, 1*c*, 1*d*, 4, 4*a*, 4*b*, 4*c*, 4*d*, 4*e* and 39, there is shown a rotating and reciprocating piston device 10 in accordance with an embodiment. Device 10 comprises a top track plate 14*a*, and a shaft 15. The device 10 comprises a ring 11 and top and bottom track plates 14*a* and 14*b*.

Figure 1:
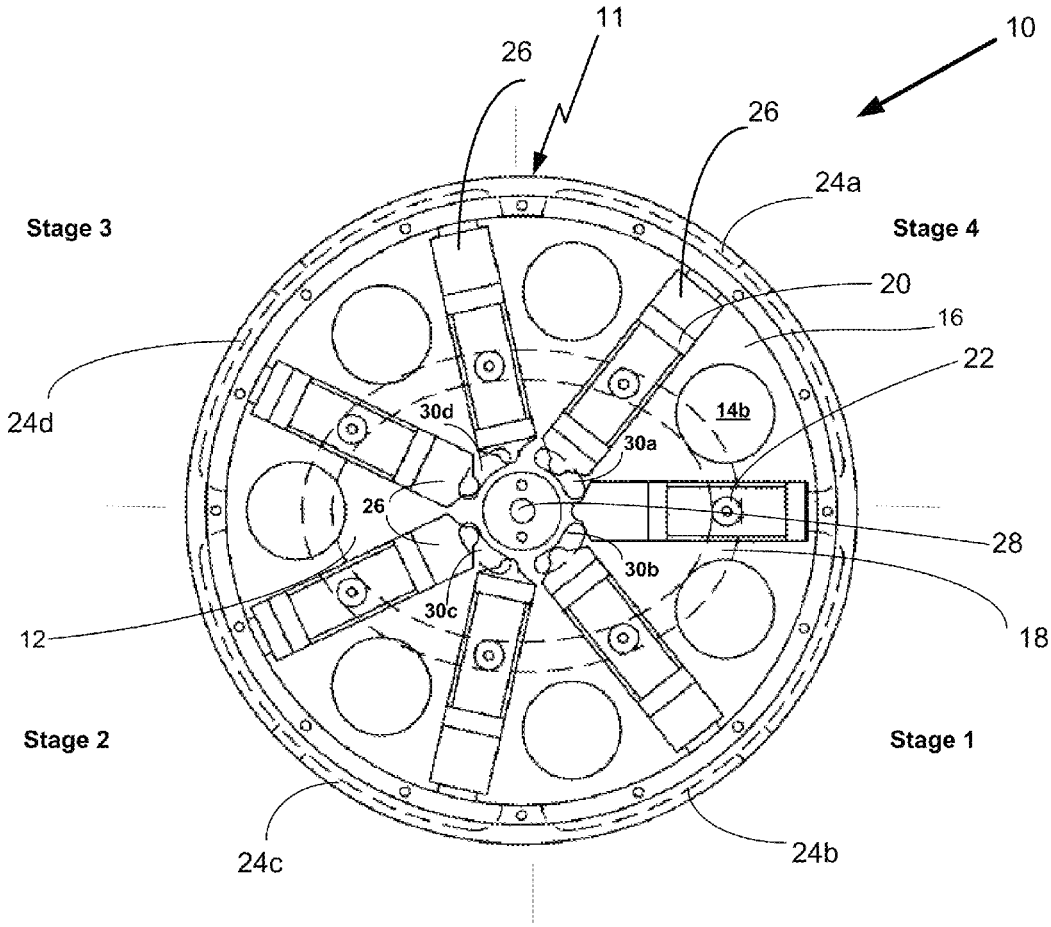
FIG. 1 is a schematic diagram showing a top plan view of an embodiment of a rotating and reciprocating piston device without one of its covers.
Figure 1A:
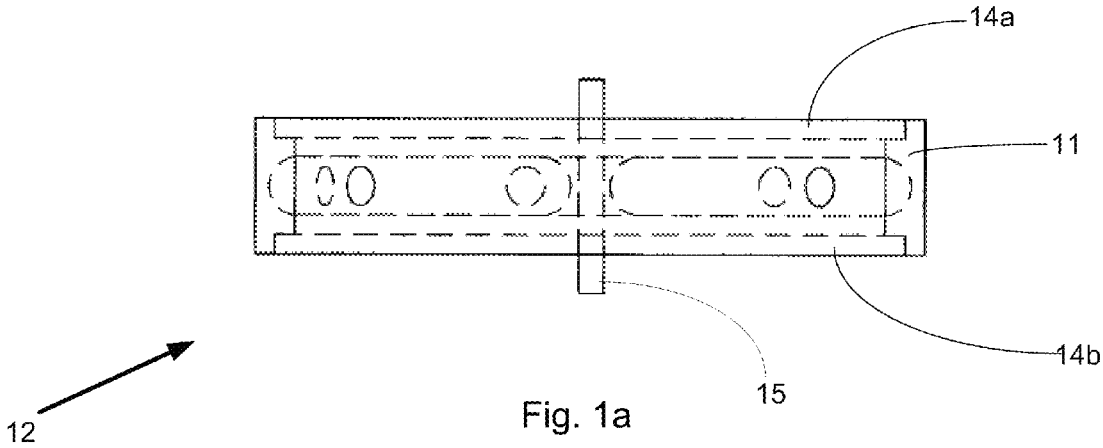
FIG. 1*a* is a cut out view of the track plate of FIG. 1.
Figure 1B:
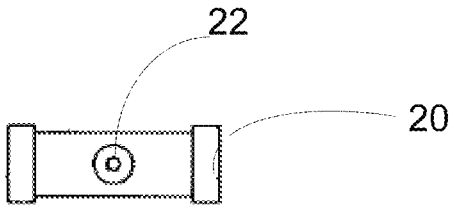
FIG. 1*b* is a diagram showing a top elevation view of an embodiment of a piston for use with the rotating and reciprocating piston device.
Figure 1C:
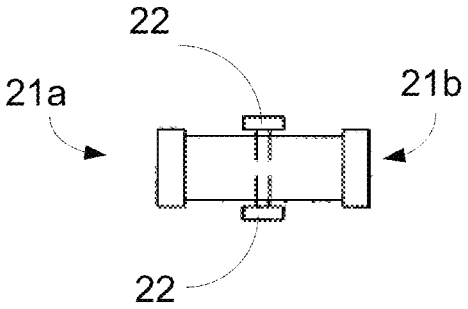
FIG. 1*c* is a diagram showing a front elevation view of an embodiment of a piston for use with the rotating and reciprocating piston device.
Figure 1D:
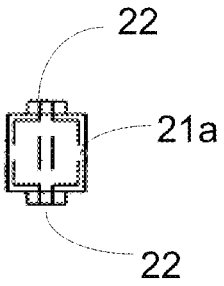
FIG. 1*d* is a schematic diagram showing a side elevation view of an embodiment of a piston for use with the rotating and reciprocating piston device.

Now referring to FIG. 1, there is shown a partial view of an embodiment of a rotating and reciprocating piston device 10 without the top track plate 14*a* (first track plate). The bottom track plate 14*b* (second track plate) is present. Device 10 comprises a stationary ring 11 having an interior portion and a hole 28 at the center of the interior portion.

The top track plate 14*a* is for covering the interior portion. The top track plate 14*a* has a hole 28 which, when the top track plate 14*a* is installed on the ring 11, is aligned with the hole 28 in the bottom track 14*b*.

Device 10 further comprises a rotatable shaft 15 for mounting through hole 28 in top and bottom track plates 14*a* and 14*b*.

Device 10 further comprises a piston chamber block 16 mounted on the rotatable shaft 15 within the interior portion of the track plate 12. The piston chamber block 16 has defined therein chambers 26.

Device 10 comprises two or more pistons 20 (seven pistons are shown in the embodiment depicted in FIG. 1) having two ends 21*a*, 21*b*. Each one of the pistons 20 is located within a respective one of the chambers 26.

According to an embodiment, each piston 20 comprises a guiding device 22. Guiding device 22 may comprise a ball bearing. The device 10 further comprises a track 18 (aka, a groove) in at least one of the track plate 12. The guiding device 22 travels within the track 18 and thereby determines a position of each piston 20 within its respective chamber 26.

During rotation of piston chamber block 16, the device 10 cycles the two or more pistons 20 through a plurality of stages. In the embodiment shown in FIG. 1, stages 1 through 4 are shown. Each piston 20 travels within its respective chamber 26 and thereby creates spaces of continuously varying sizes within its respective chamber 26 at either end of each piston 20. The spaces within the chambers 26 on either side of each of the pistons 20 admit or exhaust gases depending on the stage of the plurality of stages within which are the pistons 20.

Now referring to FIGS. 4, 4*a*, 4*b*, 4*c*, 4*d*, and 4*e* ring 11 further comprises external inlet/outlet passages 24*a*, 24*b*, 24*c*, 24*d* and internal inlet/outlet passages 30*a*, 30*b*, 30*c*, 30*d*. As will be described later, the passages have ports which act as inlets or outlets for gases to the outside of the device 10. The passages or ports may be blocked depending on the application.

Figure 2:
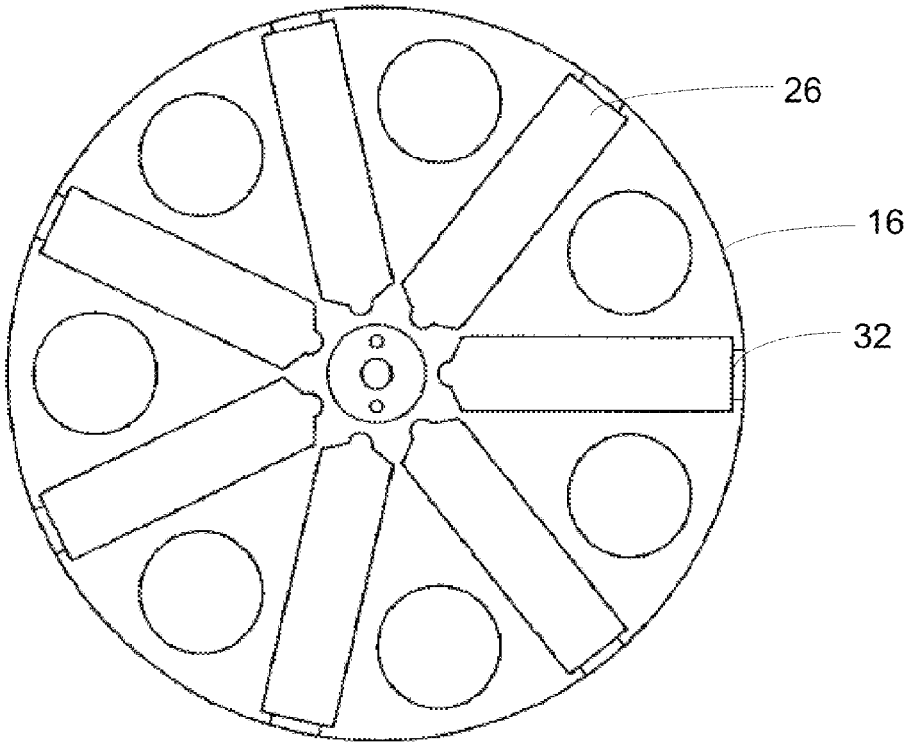
FIG. 2 is a schematic diagram showing a top plan view of an embodiment of a piston chamber block of a rotating and reciprocating piston device.
Figure 2A:
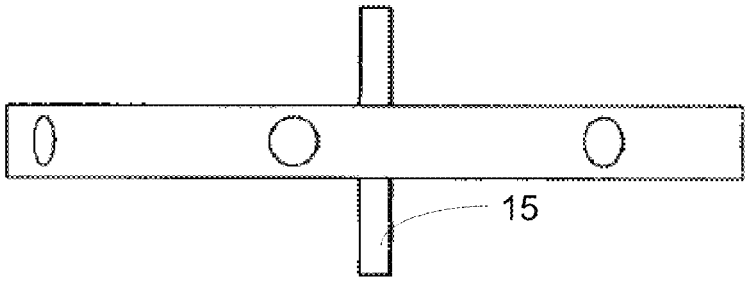
FIG. 2*a* is a side view of the piston chamber block of FIG. 2.

Now referring to FIGS. 2 and 2*a*, there is shown an embodiment of a piston chamber block 16 of a rotating and reciprocating piston device 10. Piston chamber block 16 is circular in shape and comprises chambers 26 within which pistons (not shown) may travel. The cross-section of the chambers 26 and corresponding pistons can be of any suitable for a given application, such as round, square, triangular, oval, etc. At the exterior end of each chamber is a hole 32. The holes 32 provide a passage for air or gases to travel between the chambers 26 and whichever inlet or outlet passages the holes 32 are in fluid communication with.

Figure 3:
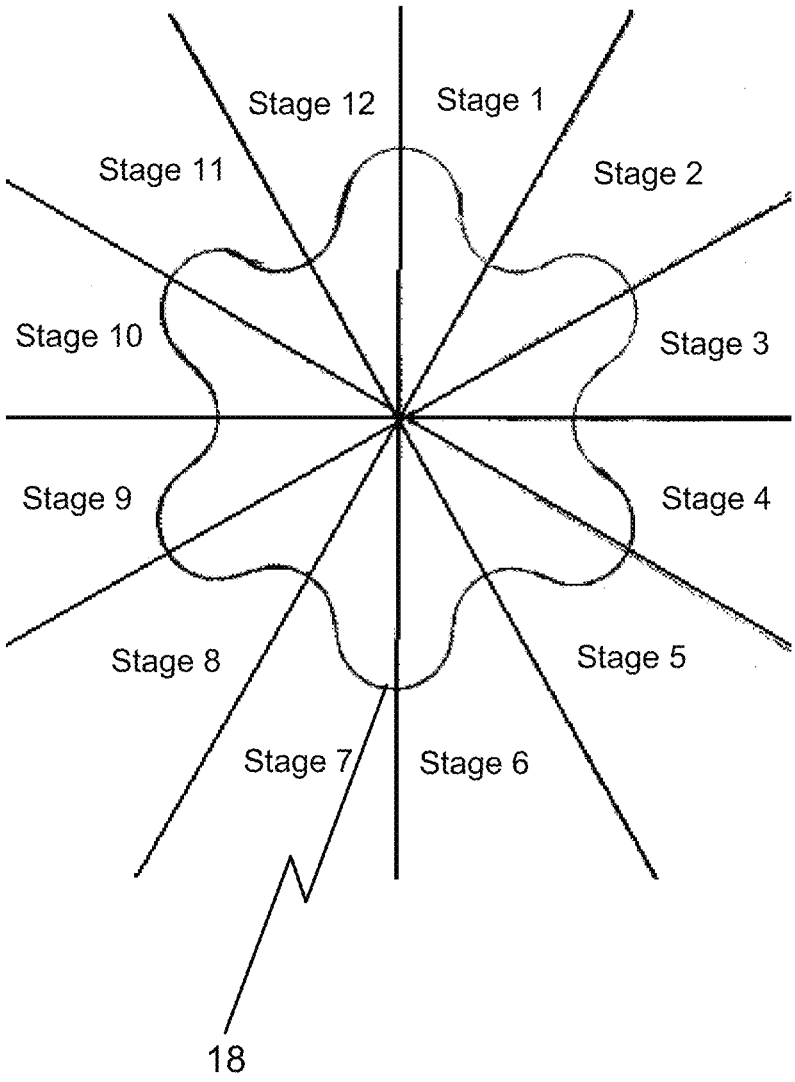
FIG. 3 is a schematic diagram showing an embodiment for a track for a 12-stage rotating and reciprocating piston device.

Now referring to FIG. 3, there is shown an embodiment for a groove for a 12-stage rotating and reciprocating piston device. For a compressor application, using such a star-shaped configuration for the track will result in a compressor with 6 stages of air admission from the inlets at the external end of the piston chamber block and 6 stages of air evacuation to the outlets at the external end of the piston chamber block along with 6 stages of air admission from the inlets at the internal end of the piston chamber block and 6 stages of air evacuation to the outlets at the internal end of the piston chamber block.

Figure 4:
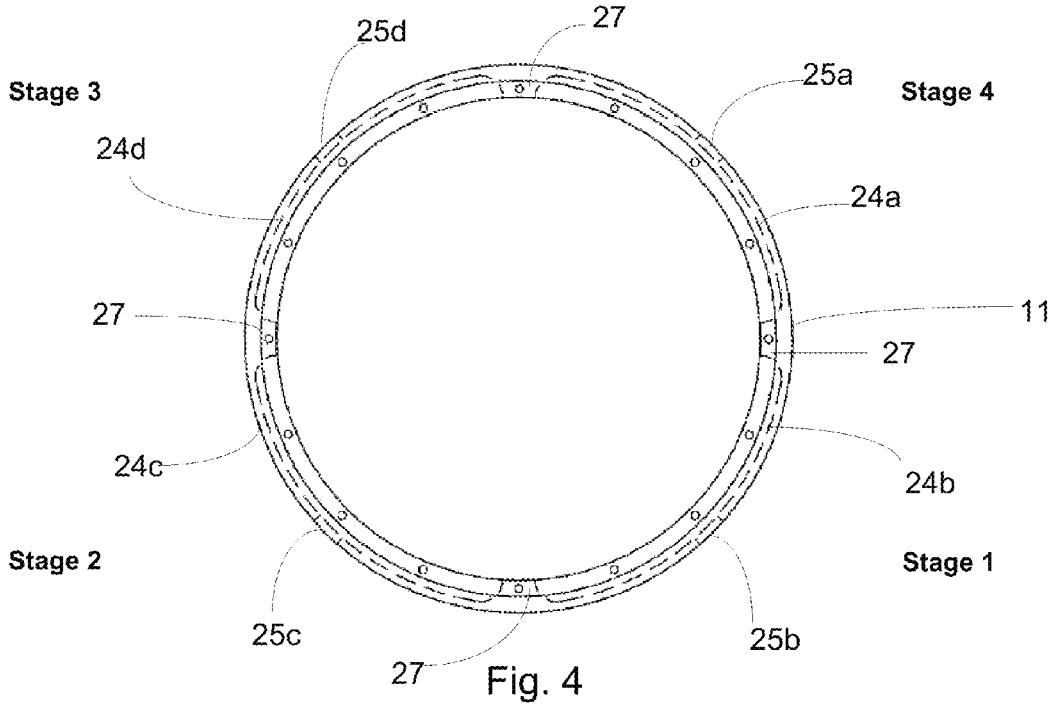
FIG. 4 is a schematic diagram showing a top plan view of an embodiment of the track plate of a rotating and reciprocating piston device.
Figure 4A:
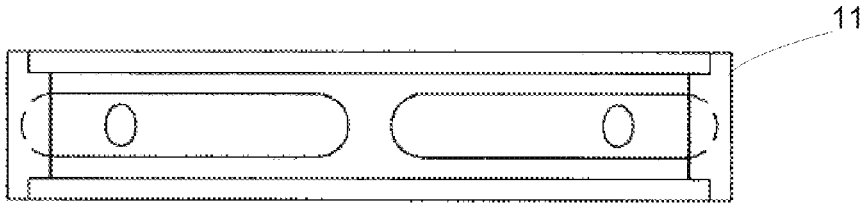
FIG. 4*a* is a schematic diagram showing a side elevation view of an embodiment of the track plate of a rotating and reciprocating piston device.
Figure 4B:
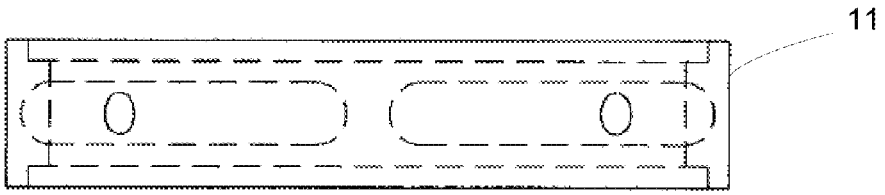
FIG. 4*b* is a schematic diagram showing a cross-sectional view of an embodiment of the track plate of a rotating and reciprocating piston device.
Figure 4C:
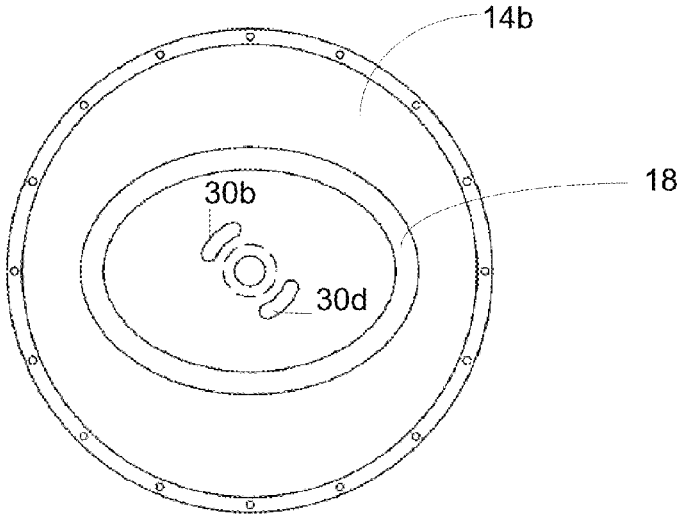
FIG. 4*c* is a schematic diagram showing a top plan view of an embodiment of the track plate with its track of a rotating and reciprocating piston device.
Figure 4D:
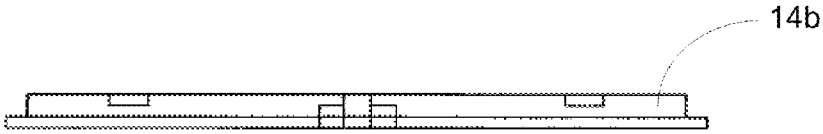
FIG. 4*d* is a schematic diagram showing a side elevation view of the device of FIG. 4*c;*
Figure 4E:
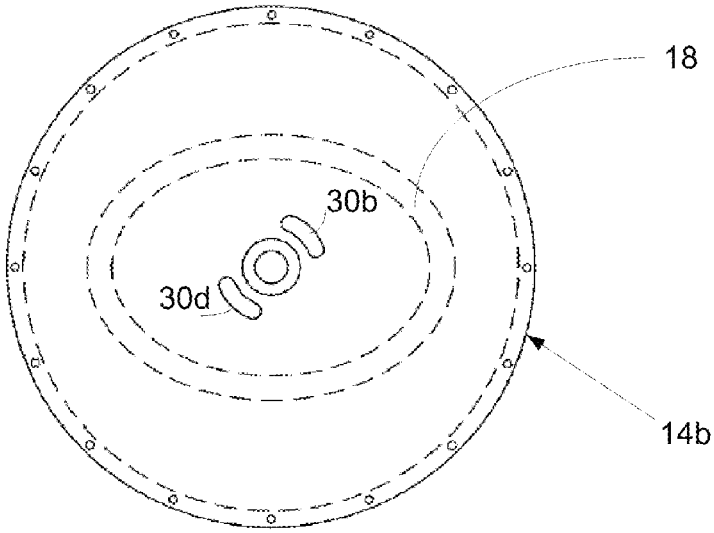
FIG. 4*e* is a schematic diagram showing a cross-sectional top plan view of an embodiment of the track plate with its track of a rotating and reciprocating piston device.

Now referring to FIG. 4, there is shown a top plan view of an embodiment of a track plate 12 of a rotating and reciprocating piston device. Track plate 12 comprises mid-portions 27 which act as separators between the external end passages 24*a*, 24*b*, 24*c* and 24*d*. Each passage includes a port 25*a*, 25*b*, 25*c* and 25*d* through which air/gases may travel from the outside to the inside or vice versa.

The operation of device 10, when used as a compressor, will now be described using the embodiment shown in FIG. 1. Starting with piston 20 in chamber 26 at the 3 o'clock position. At this position, piston 20 is entering stage 1 of the compressor when the piston chamber block 16 starts its rotation in a clockwise direction. In a compressor application, shaft 15 is powered by an external motor such as an electric motor (not shown). Guiding device 22 will follows the track 18 and force piston 20 to move toward the center (interior) of the piston chamber block 16 therefore admitting fresh air through air passage 24*b*. At the same time, air which is present in chamber 26 at the other end (or opposite side) of piston 20 will be forced out through air passage 30*b* to a compressed air tank (not shown) or to another device or tools that need air to drive it. The same piston will finish stage 1 at the 6 o'clock position where the reverse process for the piston 20 takes place; i.e., fresh air will enter from air passage 30*c* and exit through passage 24*c*. Stage 3 will be the same as stage 1 and stage 4 will be the same as stage 2.

This embodiment can also be used in a hybrid engine application. For example, when the brakes are applied on a car, the energy to drive the compressor to fill a compressed air tank can be used to help in slowing down the car. On the other hand, during acceleration of the car, the stored compressed air in the tank can be used to drive the compressor and hence help in accelerating the car.

Now referring to FIGS. 5, 6, 7, 8, 9, and 10, another embodiment of the rotating and reciprocating piston device 110 will be described. This embodiment is for a four-stroke engine. Since most components are similar or the same as those described in the previous embodiments, the emphasis will be placed on the differences between the embodiments.

Figure 5:
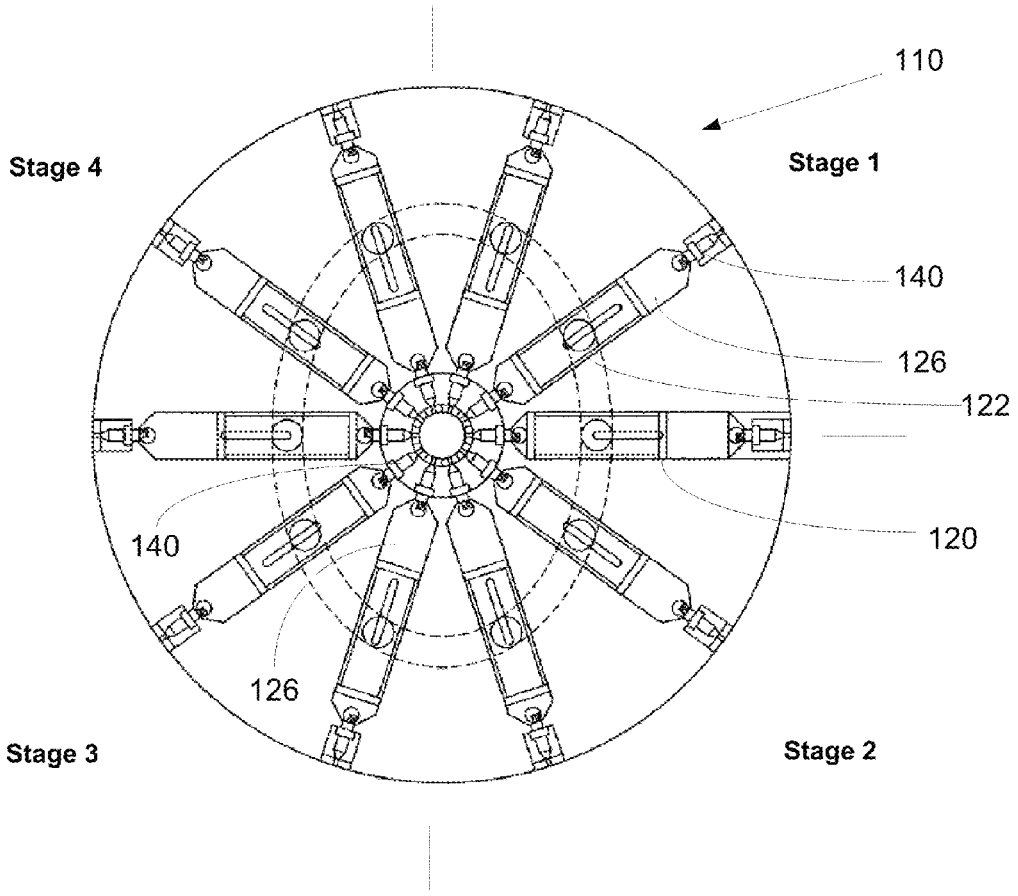
FIG. 5 is a schematic diagram showing a top plan view of another embodiment of a piston chamber block of a rotating and reciprocating piston device used in a four-stroke engine application.
Figure 6:
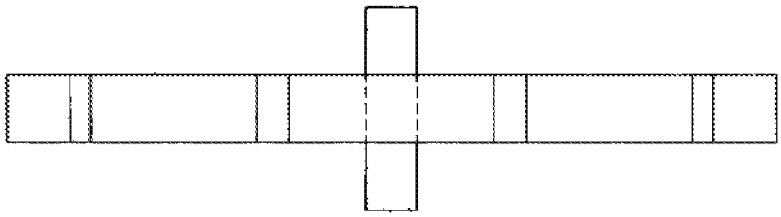
FIG. 6 is a side view of the piston chamber block of a rotating and reciprocating piston device of FIG. 5.
Figure 7:
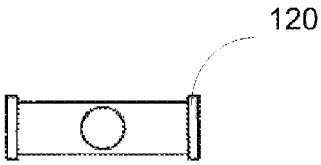
FIG. 7 is a side elevation view of a piston of FIG. 5.
Figure 8:
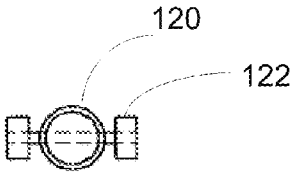
FIG. 8 is a top elevation view of a piston of FIG. 5.
Figure 9:
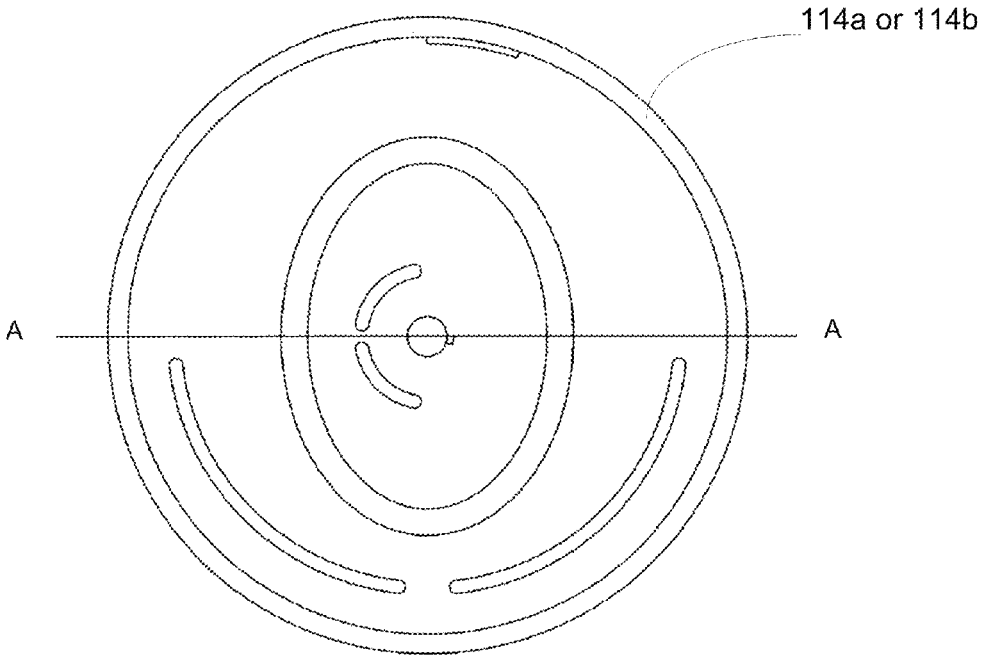
FIG. 9 is a schematic diagram showing a top plan view of the track plate of the rotating and reciprocating piston device of FIG. 5.
Figure 10:
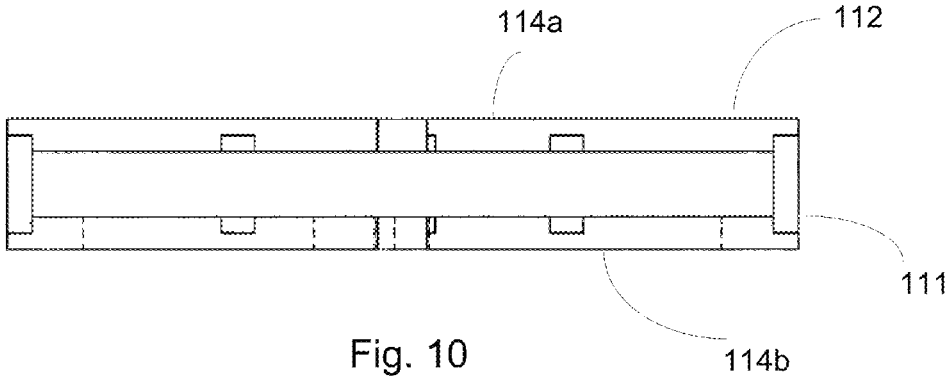
FIG. 10 is a side cutout view along line A-A of the track plate of FIG. 9.

FIGS. 5 and 6 show piston chamber block 116. FIGS. 7 and 8 show piston 120. FIG. 9 shows a cover 114*a* or 114*b*. FIG. 10 shows track plate 112 with covers 114*a* and 114*b* and ring 111.

In this embodiment of device 10, one or both spaces in the chambers 126 at either end of the pistons 120 can be used. There are provided means for admitting fuel along with air in the external space of chamber 126 during stage 3 and in the internal (center) space of chamber 126 during stage 4. There are provided means for igniting an air-fuel mixture 140 (aka, spark plug) at the external space of chamber 126 during stage 1 and at the internal space of chamber 126 during stage 2. For the external chamber, the four-stages would be as follows: stage 3: intake; stage 4: compression; stage 1: ignition; and stage 2: exhaust. For the internal chamber, the four-stages would be as follows: stage 4: intake; stage 1: compression; stage 2: ignition; and stage 3: exhaust.

Using the embodiment shown in FIG. 5 in which ten piston-chamber pairs are shown, the total process would then result in 20 ignitions for each full rotation of the piston chamber block 116.

Figure 21:
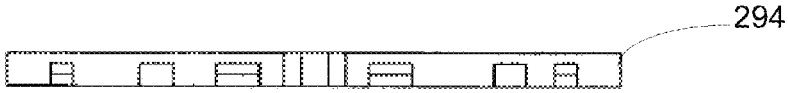
FIGS. 21 to 24 are various cutout views along line D-D of the track plate of the rotating and reciprocating piston device of FIG. 20.
Figure 22:
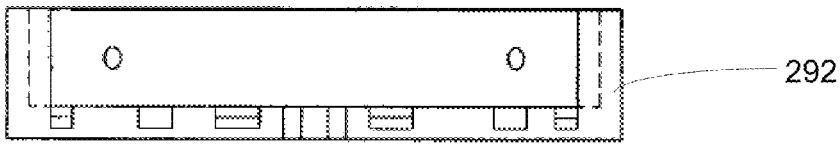
Figure 23:
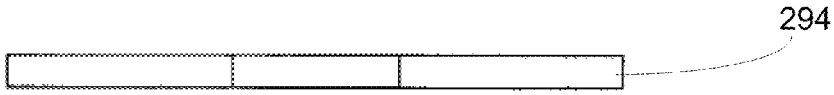
Figure 24:
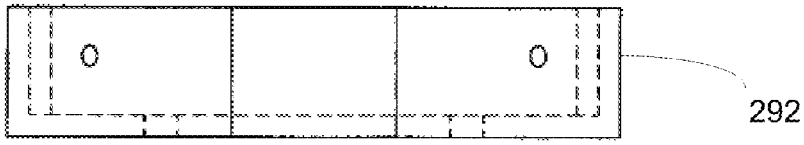
Figure 25:
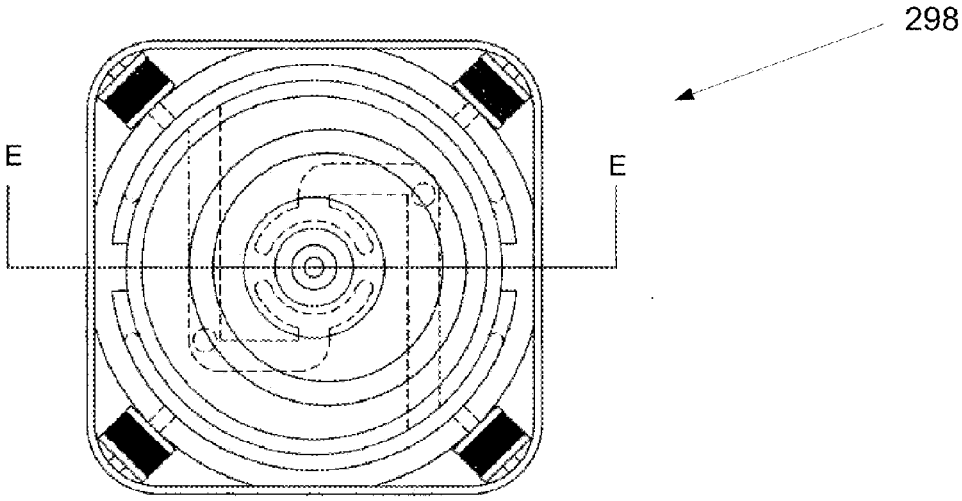
FIG. 25 is a schematic diagram showing a top plan view of another embodiment of a rotating and reciprocating piston device.
Figure 26:
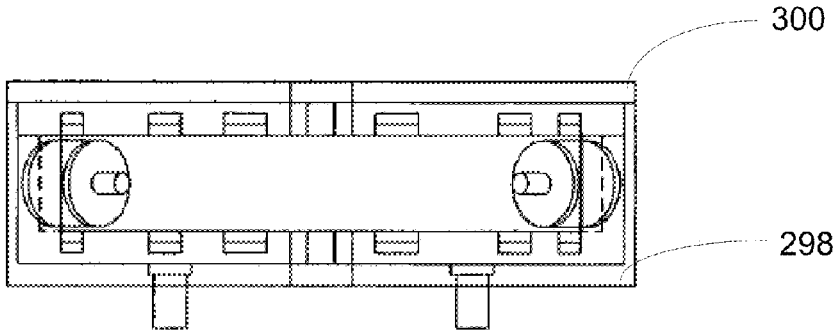
FIG. 26 is a cutout view along line E-E of the track plate of the rotating and reciprocating piston device of FIG. 25.
Figure 27:
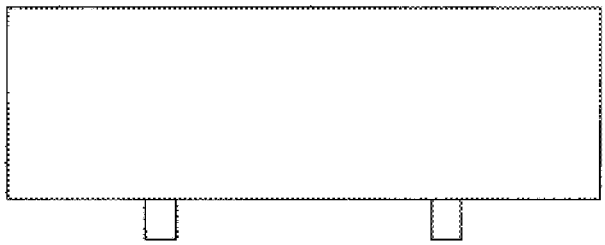
FIG. 27 is a side elevation view of the rotating and reciprocating piston device of FIG. 25.
Figure 28:
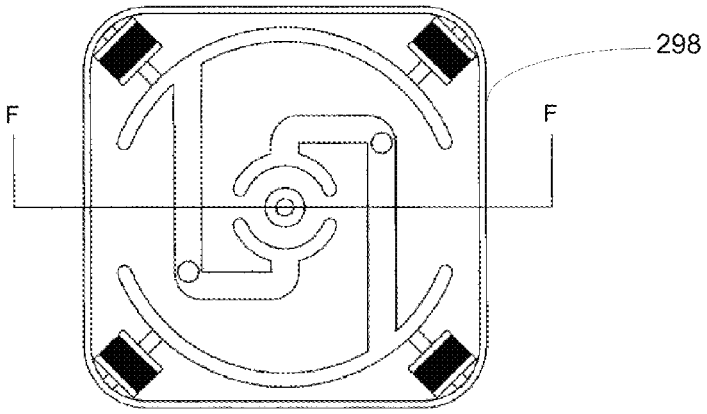
FIG. 28 is a schematic diagram showing a top plan view of another embodiment of a rotating and reciprocating piston device.
Figure 29:
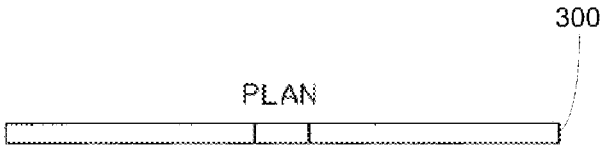
FIGS. 29 to 32 are various cutout views along line F-F of the housing of the rotating and reciprocating piston device of FIG. 28.
Figure 30:
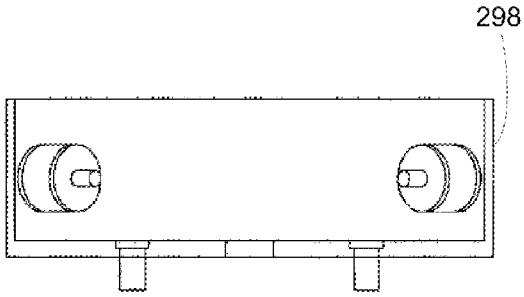
Figure 31:
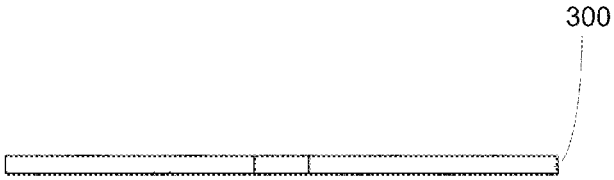
Figure 32:
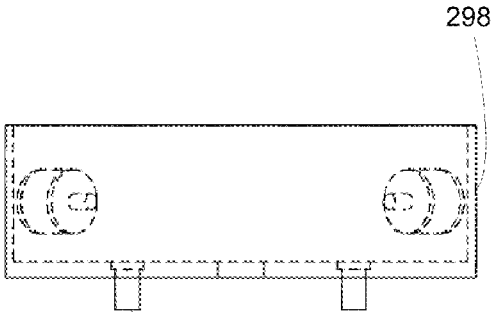

Now referring to FIGS. 11 to 32, other embodiments of the rotating and reciprocating piston device 290 will be described. It is contemplated that the device 290 can be used as an electric generator by placing electro-magnets 250 and permanent magnets 260 at appropriate positions around (or on) the piston chamber block 296 and track plate 292. There is also shown (FIG. 21) a cover 294 for track plate 292. In FIGS. 25 and 26, there is shown a housing 298 and its cover 300. This housing 298 and cover 300 assembly are used to house the track plate 292 and its cover 294.

In an exemplary embodiment, the device 290 can be used, in combination with a car engine, to store energy in a battery (not shown). The stored energy can then be used for different purpose such as utility purposes in the car or to drive the car's wheels.

Other uses include 1—using energy to drive the device 290 to produce compressed air in a compressed air tank, or 2—in combination, the energy of the piston and electrical energy can be used to increase a performance of an engine.

Figure 33:
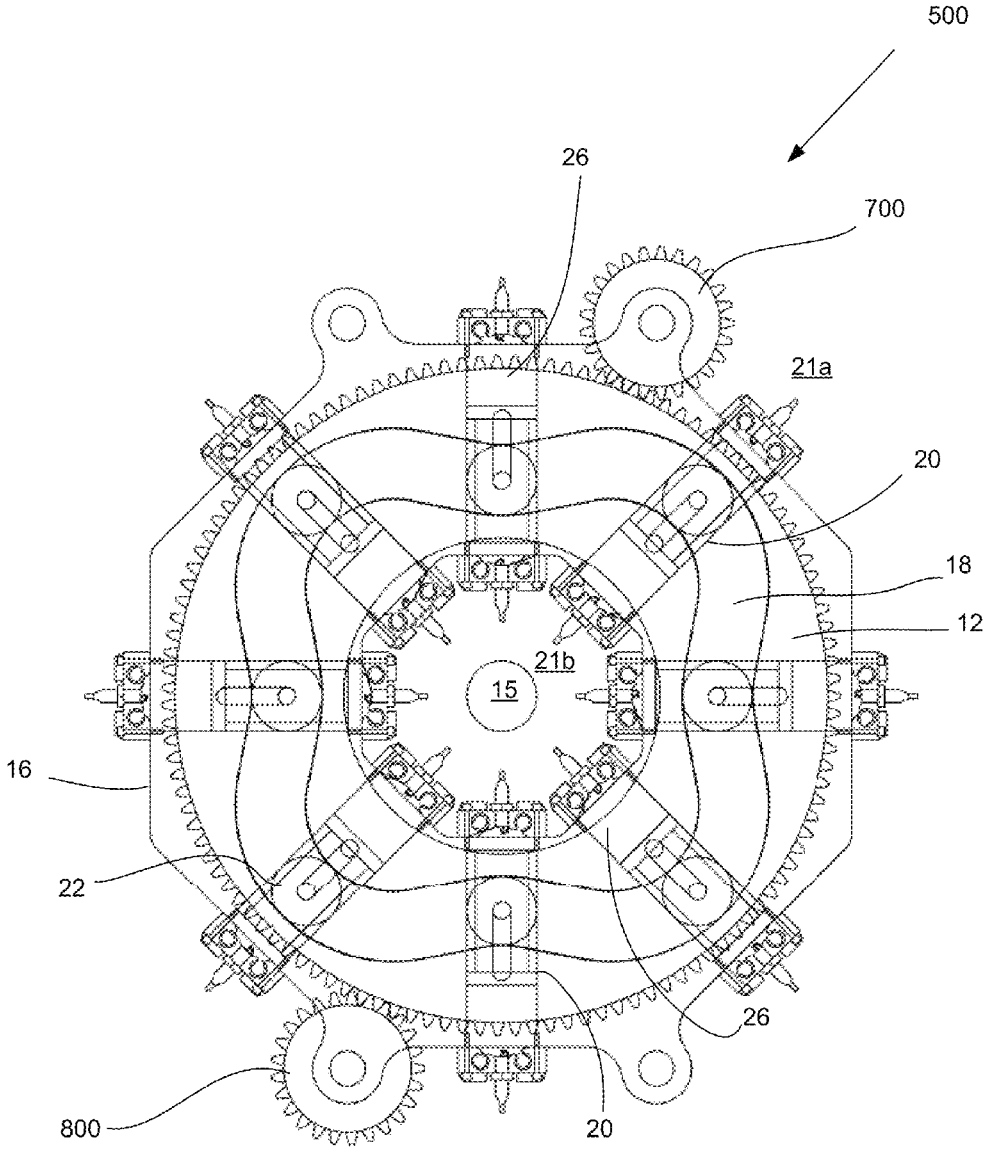
FIG. 33 is a schematic diagram showing a top plan view of another embodiment of a rotating and reciprocating piston device.

Referring now to FIG. 33, there is shown another embodiment of a rotating and reciprocating piston device 500. The device 500 comprises a track plate 12 having a track 18 forming a closed circuit. The device 500 also comprises a piston chamber block 16 having defined therein chambers 26 having two ends and an air admission or an exhaust port at each one of the ends of the chambers 26. The device 500 also comprises pistons 20 having two ends 21*a* and 21*b*, each one of the pistons 20 being located within a respective one of the chambers 26. Moreover, the device 500 comprises guiding devices 22, where each one of the guiding devices 22 is mounted to a respective one of the pistons 20. The guiding devices 22 are adapted to travel along the track 18.

During operation of the device 500, the device 500 cycles through a plurality of stages and each piston 20 travels within its respective chamber 26 and thereby creates spaces of continuously varying sizes within its respective chamber 26 at either end 21*a* or 21*b* of each piston 20. Also, during operation of the device 500, the spaces within the chambers 26 on either side of each the pistons 20 admit or exhaust gases depending on the stage of the plurality of stages within which are the pistons 20. Additionally, the track 18, via each guiding devices 22, determines a position of each piston 20 within its respective chamber 26.

It is to be noted that in the case the top and bottom track plates 14*a* and 14*b* are rotating, the piston chamber block 16 is statically mounted. On the other hand, in the case the piston chamber block 16 is rotating, the track plate 12 is statically mounted.

There is shown in FIG. 33 that the track 18 is rotating, while the piston chamber block 16 is statically mounted and the shaft 15 is connected to the track plate 12. Moreover, in the embodiment of FIG. 33, the piston chamber block 16 is static and track 18 is rotating. Indeed, a first track plate 12 rotates while engaging the shaft 15 and a second track plate 12 rotates while engaging the first track plate 12 via a gear device 700.

Figure 33A:
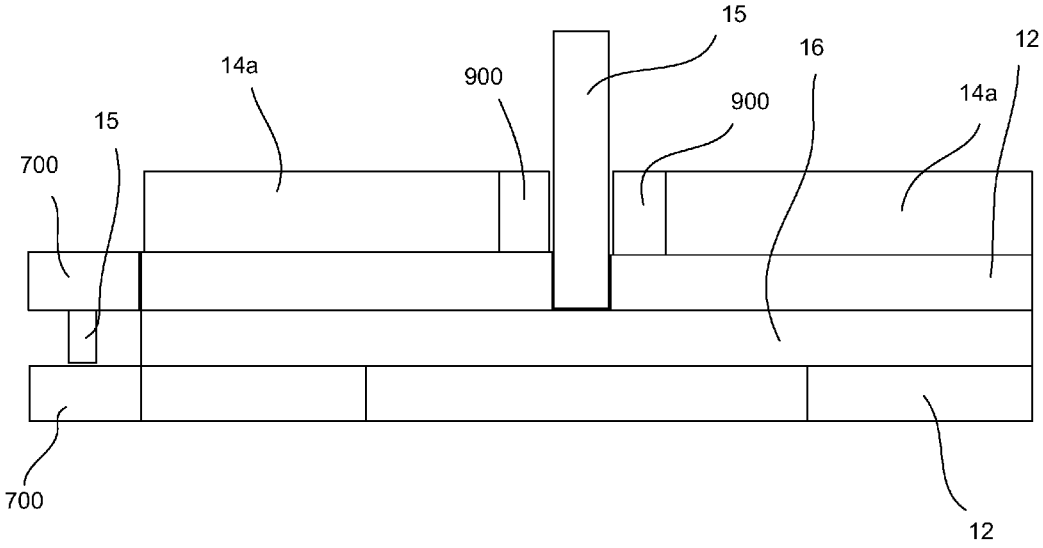
FIG. 33*a* is a schematic diagram showing a side cutout view of the rotating and reciprocating piston device of FIG. 33.

Now referring to FIG. 33*a*, there is presented a schematic diagram showing a side cutout view of the rotating and reciprocating piston device 500 of FIG. 33. The rotating and reciprocating piston device 500 comprises a piston chamber block 16 located in a chamber plane (perpendicular to drawing). A first track plate 12 is located above the piston chamber block 16 (on on side of the chamber plane) and a second track plate 12 is located below the piston chamber block (on the other side of the chamber plane). A gear device 700 drives both the first track plate 12 and the second track plate 12. A cover 14*a* for mounting over the first plate 12 which is located above the piston chamber block 16. A bearing 900 is provided in cover 14*a* to enhance the stability of shaft 15.

Figure 34:
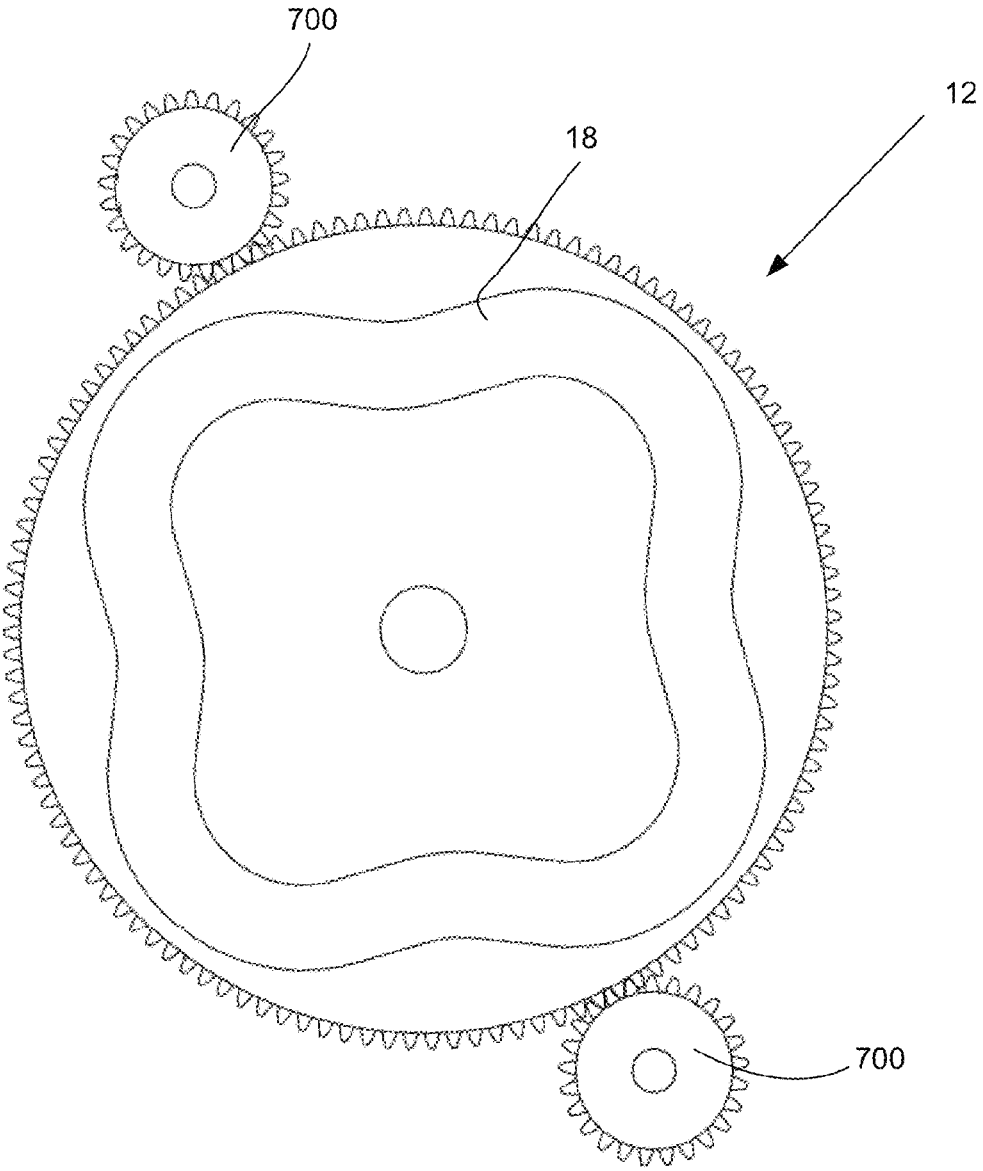
FIG. 34 is a schematic diagram showing a top plan view of the track plate with its track of the rotating and reciprocating piston device of FIG. 33.

Referring now to FIG. 34, there is shown a schematic diagram showing a top plan view of the track plate 12 with its track 18 and its gears 700 of the rotating and reciprocating piston device 500 of FIG. 33.

Figure 35:
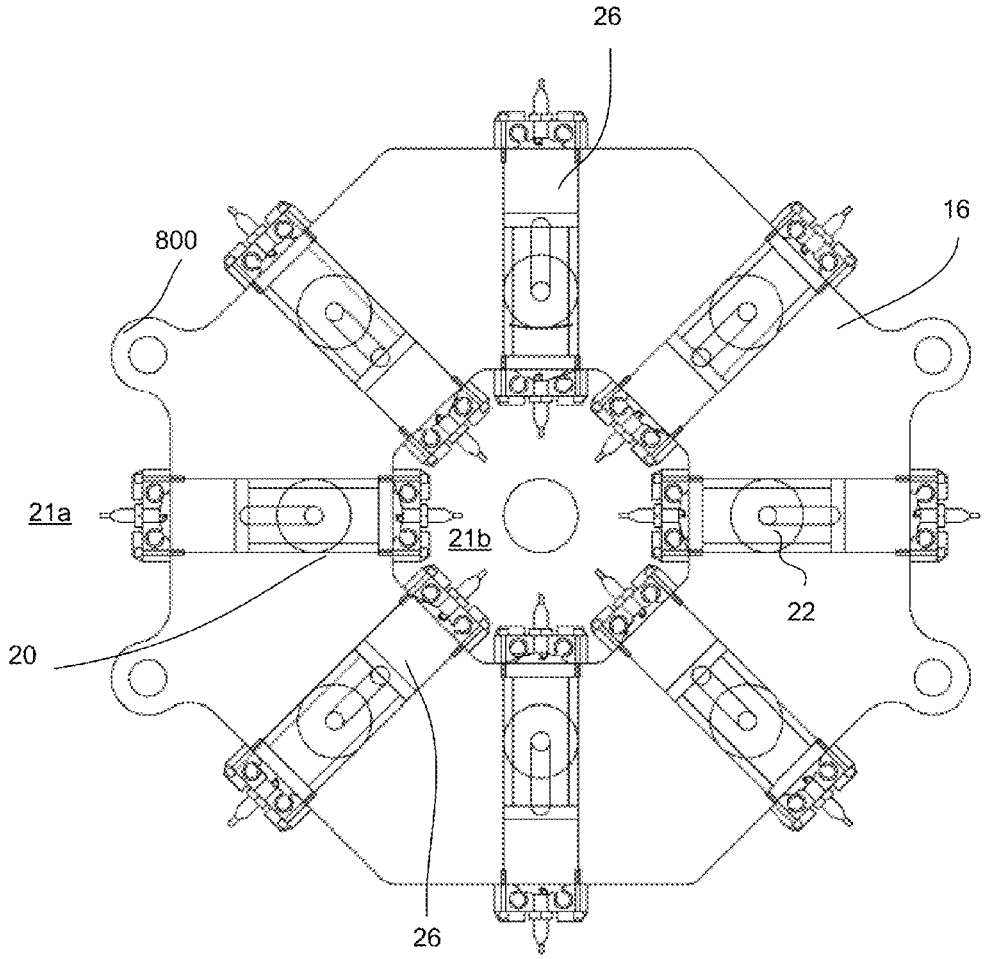
FIG. 35 is a schematic diagram showing a top plan view of the piston chamber block of the rotating and reciprocating piston device of FIG. 33.

Referring now to FIG. 35, there is shown a schematic diagram showing a top plan view of the piston chamber block 16 of the rotating and reciprocating piston device 500 of FIG. 33. There is also shown that the piston chamber block 16 further includes a shaft receptor portion 800 for connecting to track plate 12.

Figure 36:
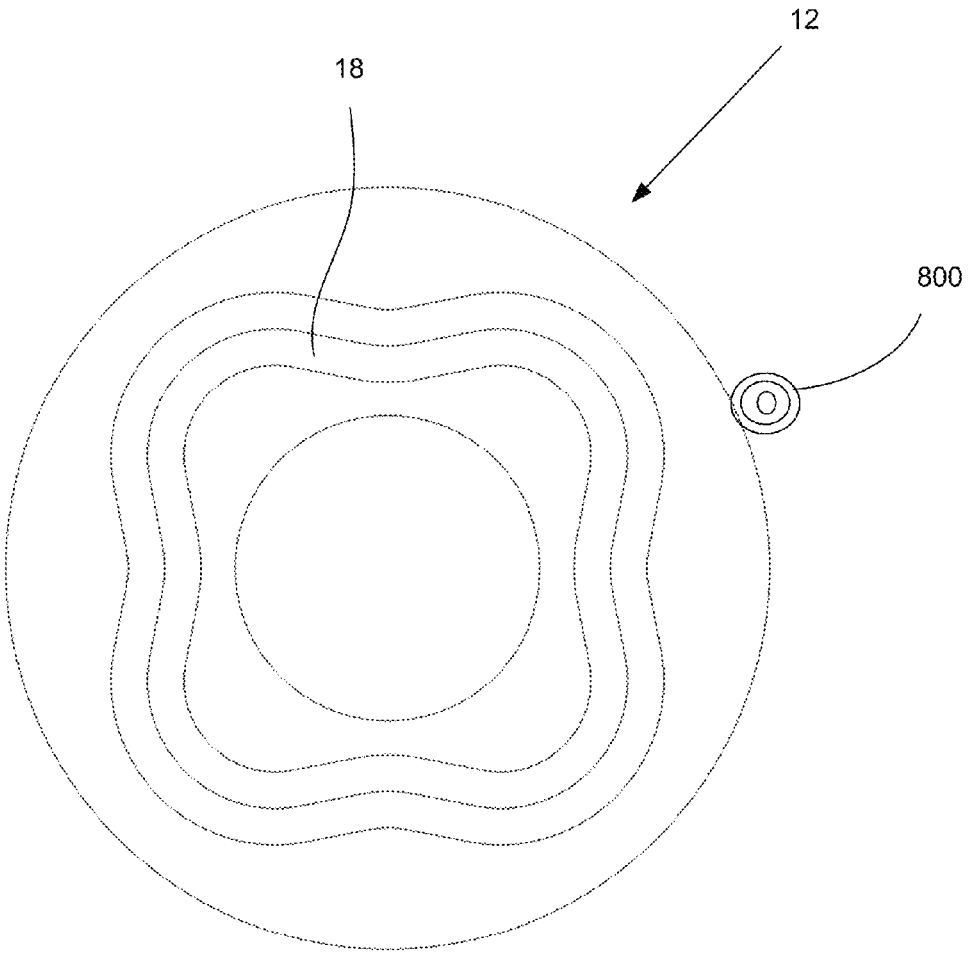
FIG. 36 is a schematic diagram showing a top plan view of another track plate with its track of the rotating and reciprocating piston device of FIG. 33

Referring now to FIG. 36, there is a shown a schematic diagram showing a top plan view of the second track plate 12 with its track 18 of the rotating and reciprocating piston 500 device of FIG. 33. There is also shown that the piston chamber block 16 further includes a shaft receptor portion 800 for connecting to track plate 12.

Figure 37:
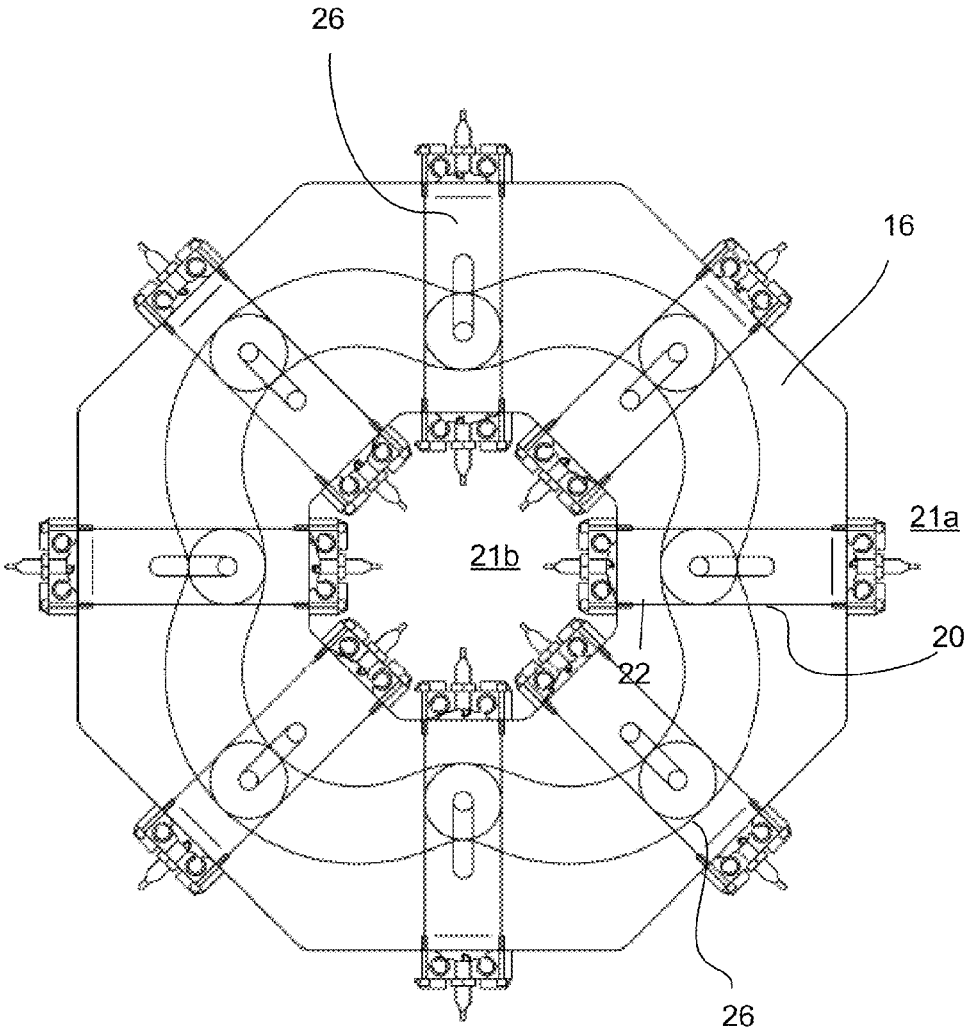
FIG. 37 is a schematic diagram showing a top plan view of another embodiment of the piston chamber block of the rotating and reciprocating piston device of FIG. 33.

Referring now to FIG. 37, there is shown a schematic diagram showing a top plan view of another embodiment of the piston chamber block 16 of the rotating and reciprocating piston device 500 of FIG. 33.

Figure 38:
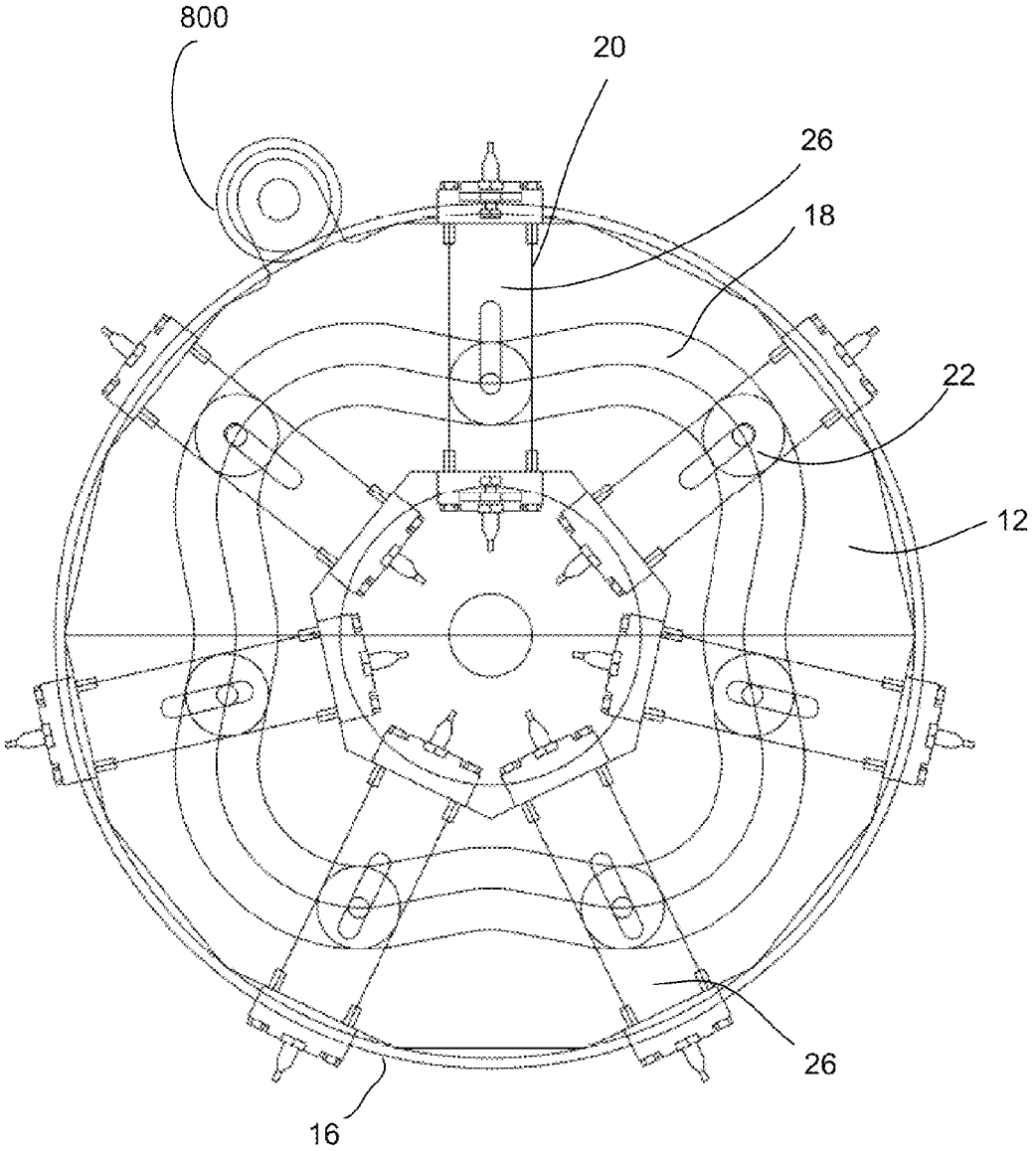
FIG. 38 is a schematic diagram showing a top plan view of the piston chamber block with the track plate of the rotating and reciprocating piston device of FIG. 33.

Finally, Referring now to FIG. 38, there is shown a schematic diagram showing a top plan view of the piston chamber block 16 with the track plate 12 of the rotating and reciprocating piston device 500 of FIG. 33.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A rotating and reciprocating piston device comprising:

chambers having two ends and a port for passage of a fluid at each one of the two ends of the chambers;

pistons having two ends, each one of the pistons slidably positioned within a respective one of the chambers thereby determining a space at either end of each piston within its respective chamber, each one of the two ends of the pistons for pushing the fluid towards the port at one of the two ends of its respective chamber;

a track forming a closed circuit which remains between the two ends of each one of the chambers; and guiding devices, each one of the guiding devices for guiding a respective one of the pistons along the track and for moving a respective one of the pistons within a respective chamber;

wherein during operation:

the rotating and reciprocating piston device cycles through a plurality of stages wherein a position of a piston within its respective chamber determines the stage for that piston and hence the space on either side thereof;

each piston slides within its respective chamber and thereby continuously varies the space at either end of each piston within its respective chamber; and each port admits or exhausts the fluid respectively to or from the space depending on the stage of the plurality of stages; and wherein when the chambers are static the track is rotating about the chamber axis, and when the track is static the chambers are rotating about the chamber axis.

2. The rotating and reciprocating piston device of claim 1, further comprising a transmission device for transmitting energy to or receiving energy from the rotating and reciprocating piston device.

3. The rotating and reciprocating piston device of claim 2, wherein the transmission device comprises one of a shaft, a belt, a chain, a gear mechanism, a wheel, and an electromagnetic device.

4. The rotating and reciprocating piston device of claim 1, further comprising a track plate on which the track is located.

5. The rotating and reciprocating piston device of claim 4, wherein the chambers are located with a chamber plane and wherein the track plate comprises a first track plate and a second track plate, each track plate comprising a track, the first track plate located on one side of the chamber plane and the second track plate located on the opposite side of the chamber plane.

6. The rotating and reciprocating piston device of claim 5, wherein the first track plate and the second track plate are connected via a gear device.

7. The rotating and reciprocating piston device of claim 6, wherein the first track plate further comprises a shaft receptor portion located in the chamber axis for mounting a rotatable shaft to the first track plate, the rotatable shaft for transmitting or receiving energy to or from the rotating and reciprocating piston device.

8. The rotating and reciprocating piston device of claim 6, wherein the gear device comprises a gear device axis about which the gear device rotates during operation, a rotatable shaft and a shaft receptor portion located in the gear device axis for mounting the rotatable shaft to the gear device, the rotatable shaft for one of: transmitting and receiving energy to or from the rotating and reciprocating piston device respectively.

9. The rotating and reciprocating piston device of claim 1, further comprising a piston chamber block located within a chamber plane, the chambers being formed in the chamber block.

10. The rotating and reciprocating piston device of claim 9, wherein the piston chamber block further comprises a shaft receptor portion in the central axis for connecting a rotatable shaft to the track plate.

11. The rotating and reciprocating piston device of claim 1, wherein the track comprises one of a groove.

12. The rotating and reciprocating piston device of claim 1, wherein the track comprises a symmetrical shape.

13. The rotating and reciprocating piston device of claim 12, wherein the symmetrical shape is either centered on the chamber axis or off center from on the chamber axis.

14. The rotating and reciprocating piston device of claim 1, further comprising spark plugs, a respective one of the spark plugs located at each of the two ends of each of the chambers.

15. The rotating and reciprocating piston device of claim 1, wherein the number of pistons is equal to the number of chambers.

16. A rotating and reciprocating piston device comprising:

chambers having two ends and a port for passage of a fluid at each one of the two ends of the chambers;

pistons having two ends, each one of the pistons slidably positioned within a respective one of the chambers thereby determining a space at either end of each piston within its respective chamber, each one of the two ends for pushing the fluid towards the port at one of the two ends of its respective chamber; and a track forming a closed circuit which remains between the two ends of each one of the chambers, the track for determining a position of a piston within its respective chamber and hence the space on either side thereof;

wherein when the chambers are static the track is rotating about the chamber axis, and when the track is static the chambers are rotating about the chamber axis.

* * * * *